US008702421B2

(12) United States Patent
Yamamoto et al.

(10) Patent No.: US 8,702,421 B2
(45) Date of Patent: Apr. 22, 2014

(54) BURNER

(75) Inventors: Akira Yamamoto, Gamagori (JP); Hiroshi Yamamoto, Toyokawa (JP)

(73) Assignee: Shinfuji Burner Co., Ltd., Aichi (JP)

( * ) Notice: Subject to any disclaimer, the term of this patent is extended or adjusted under 35 U.S.C. 154(b) by 572 days.

(21) Appl. No.: 12/922,866

(22) PCT Filed: Mar. 19, 2009

(86) PCT No.: PCT/JP2009/055407
§ 371 (c)(1),
(2), (4) Date: Sep. 16, 2010

(87) PCT Pub. No.: WO2009/119432
PCT Pub. Date: Oct. 1, 2009

(65) Prior Publication Data

US 2011/0027733 A1 Feb. 3, 2011

(30) Foreign Application Priority Data

Mar. 24, 2008 (JP) ..... 2008-076043
Mar. 25, 2008 (JP) ..... 2008-077801

(51) Int. Cl.
*F23Q 7/12* (2006.01)
*F23Q 7/06* (2006.01)

(52) U.S. Cl.
USPC ..... 431/255; 431/254; 431/258

(58) Field of Classification Search
USPC ..... 431/255, 254, 256, 344, 132, 24, 127, 431/129, 144; 313/574; 219/368; 361/258
See application file for complete search history.

(56) References Cited

U.S. PATENT DOCUMENTS 3,330,267 A * 7/1967 Bauer ..... 126/92 R
2006/0040374 A1 * 2/2006 Nishiyama et al. ..... 435/285.1

FOREIGN PATENT DOCUMENTS

| | | | |
|---|---|---|---|
| GB | 1 323 639 | 7/1973 | |
| JP | 47-33873 | 10/1972 | |
| JP | 55-22885 | 6/1980 | |
| JP | 60-21864 | 2/1985 | |
| JP | 60021864 U * | 2/1985 | ..... F23Q 3/00 |
| JP | 2000-104925 | 4/2000 | |
| JP | 2000-193239 | 7/2000 | |
| JP | 2005-317514 | 11/2005 | |

OTHER PUBLICATIONS

Notice of Reasons for Rejection issued Oct. 30, 2012 in JP 2008-076043 which is a foreign counterpart to the present application (and its partial English translation).
International Search Report issued May 19, 2009 in International (PCT) Application No. PCT/JP2009/055407.

* cited by examiner

*Primary Examiner* — Len Tran
*Assistant Examiner* — Tiffany Johnson
(74) *Attorney, Agent, or Firm* — Wenderoth, Lind & Ponack, L.L.P.

(57) ABSTRACT

A burner includes a housing 1, an intake pipe 3 and a burner head 4. Gas in the housing 1 is supplied to the burner head 4 through the intake pipe 3. An electric wire 8 extends through the intake pipe 3 which connects a piezoelectric element 7 to a core wire 10 from which electric discharge is generated near burner ports 9 of the burner head 4 by the piezoelectric element 7. Since the wire 8 is not exposed to outside the intake pipe 3, the wire 8 is never caught and damaged by an external object. Since air-gas mixture which is kept at around the room temperature is flowing through the intake pipe 3, the wire 8 is less likely to overheat during use of the burner. Thus, it is not necessary to provide the wire 8 with a shield plate for protecting the wire 8.

4 Claims, 9 Drawing Sheets

BURNER

TECHNICAL BACKGROUND

This invention relates to a burner including an ignition device having improved wiring.

BACKGROUND ART

Burners used indoors and outdoors include those having a small gas cylinder containing liquefied gas such as butane, and a burner head wherein liquefied gas in the gas cylinder is vaporized and burned at the burner head. Some of these burners include means for generating electric discharge such as a piezoelectric element so that gas can be readily ignited at locations where fire sources are not readily available, such as at outdoor camping sites (see e.g. JP2000-104925A).

FIG. 11 shows an ordinary burner. This burner includes a housing 1, and a small gas cylinder B mounted to the housing 1 through a cylinder holder 2. Gas in the cylinder B is fed into the housing 1. This burner further includes a burner head 4 mounted to the housing through an intake pipe 3. The gas fed into the housing 1 is supplied to the burner head 4 after being mixed with air taken in through an air inlet port 5 formed in the intake pipe 3. The amount of gas supplied to the burner head 4 is adjustable by adjusting the amount a spindle 6 is screwed into the housing 1.

A piezoelectric element 7 is mounted to the housing 1. The piezoelectric element 7 is connected through an electric wire 8 to a core wire 10 located adjacent to burner ports 9 formed in the burner head 4. Electric discharge is generated by depressing a piezoelectric switch 11. The position of the core wire 10 is not particularly limited provided gas can be reliably ignited by the electric discharge between the core wire 10 and the burner head 4. But ordinarily, it is preferably provided adjacent to the center of the concentric circles along which the burner ports are arranged (and thus remote from the peripheral edge of the burner head 4). By providing the core wire 10 adjacent to the center of the concentric circles along which the burner ports are arranged, it is possible to minimize the distance between the core wire 10 and the burner port remotest from the core wire, so that all the burner ports 9 can be ignited quickly.

When the core wire 10 is provided adjacent to the center of the above concentric circles, as shown in FIG. 11, the electric wire 8 is ordinarily arranged to extend beside and parallel to the intake pipe 3 and further extend through holes 12 formed through both the bottom and top surfaces of the burner head 4, and is connected to the core wire 10. If the core wire 10 or the electric wire 8 directly contacts the burner head 4 at one of the through holes 12 and short-circuiting occurs therebetween, no normal electric discharge occurs. Also, if there is a gap between one of the through holes 12 and the core 10 or the electric wire 8, air-gas mixture leaks through this gap. Thus, ceramic insulators 13 are used to close the through holes 12, thereby preventing short-circuiting and leakage of air-gas mixture.

In this conventional arrangement, since the wire 8 is provided outside the intake pipe 3, the wire 8 may be caught by an external object and damaged during transportation. Also, flames of the burner head 4 may overheat and deteriorate the wire 8, thereby shortening its life. Thus, in order to prevent contact to the wire 8 and leakage of air-gas mixture, the wire 8 is provided with shield plate 26 (see FIG. 11). Provision of the shield plate 26 however complicates the manufacturing steps and increases the manufacturing cost.

SUMMARY OF THE INVENTION

An object of the present invention is to prevent damage to and overheating of the electric wire for electric discharge/ignition, thereby increasing its life, without increase in cost.

In order to achieve this object, according to the present invention, the above-mentioned electric wire or the means for generating electric discharge are arranged to extend through the intake pipe. By arranging the electric wire or the electric discharge means to extend through the intake pipe, since the wire or the means is not exposed, it is never damaged by being caught by an external object during transportation. Also, because the air-gas mixture is flowing through the intake pipe, and the mixture is always kept at around the room temperature, the wire or the means is less likely to be overheated and deteriorate.

In a specific arrangement, the burner according to the present invention comprises a burner head having burner ports, an intake pipe through which a mixture of gas and air is configured to be supplied to the burner head so as to be released through the burner ports, and a core wire provided adjacent to the burner ports for generating electric discharge therefrom, thereby igniting the mixture, wherein the burner further comprises means for generating electric discharge from the core wire, and an electric wire extending through the intake pipe and connecting the core wire to the means, the burner head being formed with a through hole through which the core wire extends from inside to outside the burner head, and wherein an insulator is disposed between the core wire and the burner head to keep the core wire insulated from the burner head. The insulator may be a ceramic insulator. A ceramic insulator is inexpensive and has a relatively high heat resistance.

Since the electric wire extends through the intake pipe to the burner head, only one through hole is necessary to protrude the core wire from the burner head. Thus, compared to the conventional burner (see FIG. 11), in which it is necessary to form two through holes, it is possible to omit manufacturing steps of the burner head (steps of forming the additional through hole and fitting the insulator in the additional through hole). Also, even if air-gas mixture leaks through the gap between the burner head and the through hole, this has no influence on the burning state. Thus, no strict air tightness is required therebetween as with the conventional burner.

The core and the electric wire may not necessarily be separate members. For example, the free end of the electric wire may be protruded from the ceramic insulator as the core wire.

In this arrangement, instead of connecting the core wire to the means for generating electric discharge by means of the wire, the means for generating electric discharge may be extended to the burner head so that one end of the means protrudes from the burner head, the core wire comprising the one end of the means.

With this arrangement, it is not necessary to connect the electric wire to the electric discharge generating means, so that the burner can be assembled more easily. Also, it is possible to reduce the number of parts used.

In this arrangement, the electric discharge generating means may be a piezoelectric element. Since a piezoelectric element can generate electric discharge without the need for an external power source such as a battery, the burner can be used e.g. outdoors where no external power sources are readily available.

According to this invention, since the electric wire that connects the core wire to the electric discharge generating means or the electric discharge generating means itself is arranged to extend through the intake pipe, the wire or the electric discharge generating means is never caught and damaged by an external object during transportation. Also, the wire or the electric discharge generating means is less likely to deteriorate due to overheating during use of the burner. This eliminates the necessity to provide the wire or the electric discharge generating means with e.g. a shield plate, which in turn makes it possible to reduce its manufacturing cost. Also, it is possible to prolong the life of the burner.

BRIEF DESCRIPTION OF THE DRAWINGS

FIG. 2(*b*) is its sectional side view.

FIG. 4(*b*) is its sectional side view.

DETAILED DESCRIPTION OF THE INVENTION

Figure 1:
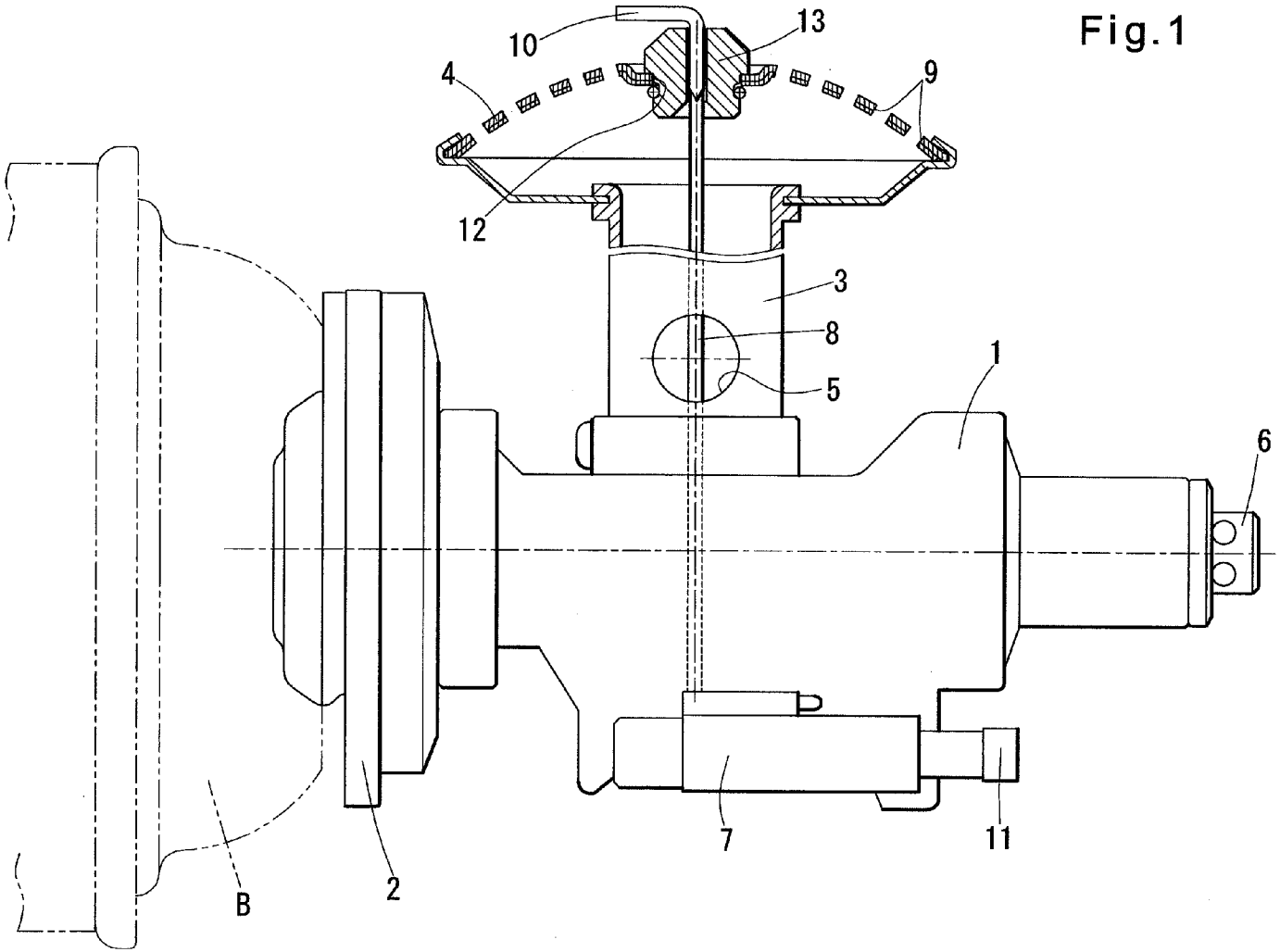
FIG. 1 is a partially sectional side view of a burner embodying the present invention.

FIG. 1 shows a burner embodying the present invention. As with conventional burners, this burner includes a housing 1 into which gas from a gas cylinder B, mounted to the housing 1 through a cylinder holder 2, is supplied, and the gas supplied into the housing B is mixed with air taken in through an air inlet 5 formed in an intake pipe 3, and supplied to burner ports 9 of a burner head 4. The amount of gas supplied is adjusted by adjusting the amount a spindle 6 is screwed into the housing 1.

The burner head 4 has a through hole 12 extending through the center of its top surface. A ceramic insulator 13 is fitted in the through hole 12, closing the through hole 12. A core wire 10 is embedded in the ceramic insulator 13 and has a first end protruding outwardly from the burner head 4 so that electric discharge occurs between the first end of the wire 10 and the top surface of the burner head 4. The core wire 10 has a second end protruding into the burner head 4 and connected to a piezoelectric element 7 provided in the housing 1 through an electric wire 8 extending through the intake pipe 3. By depressing a piezoelectric switch 11 of the piezoelectric element 7, electric discharge occurs from the first end of the core wire 10, which ignites and burns the gas supplied to the burner ports 9.

Figure 2A:
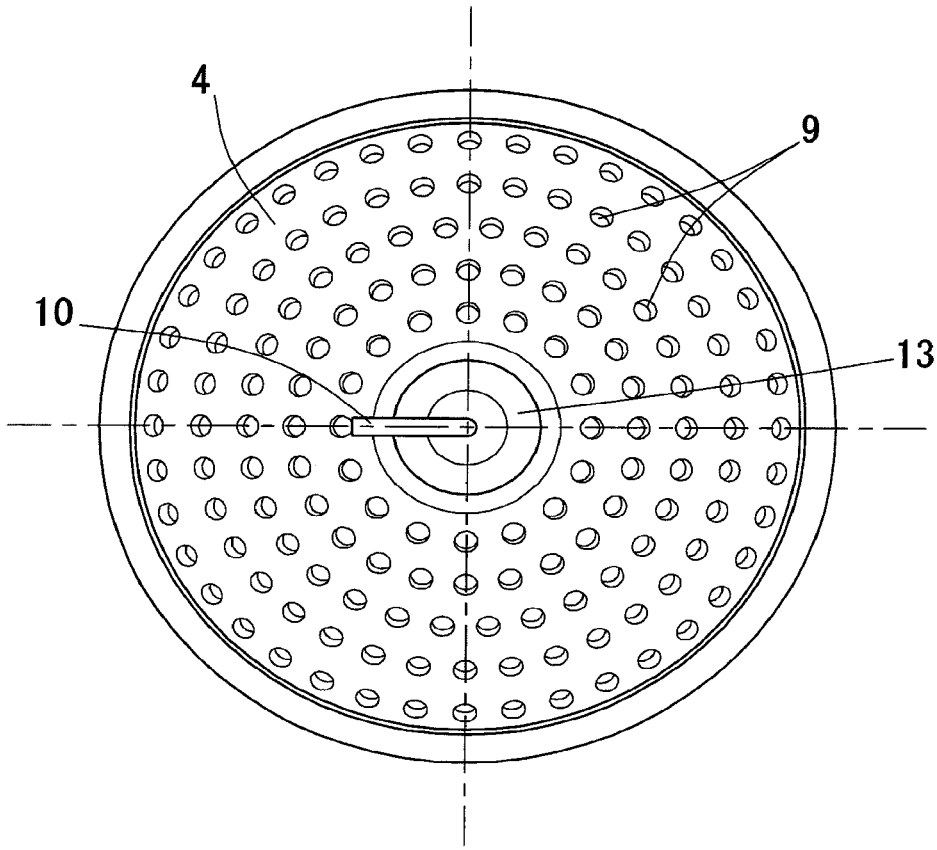
FIG. 2(*a*) is a plan view of a burner head of the burner according to the present invention.
Figure 2B:
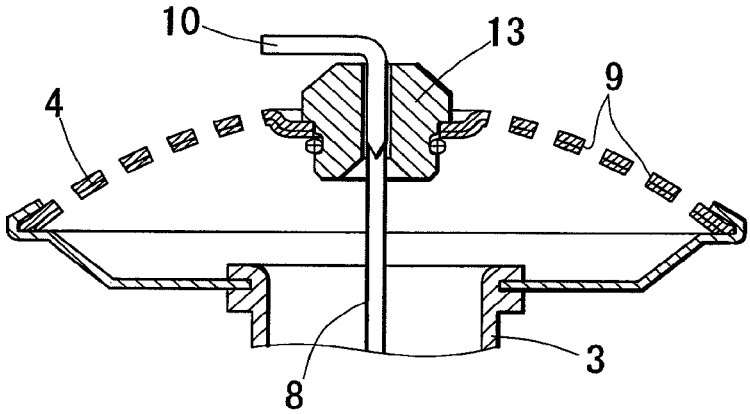

As shown in FIGS. 2(*a*) and 2(*b*), the core wire 10 is directed toward a radially inner one of the concentrically arranged burner ports 9. Thus, gas supplied to this radially inner one of the burner ports 9 is first ignited, and from this point, flames spread circumferentially and simultaneously radially outwardly. Thus, compared to the arrangement in which the core wire is directed toward an area near the outer edge of the burner head 4, all the burner ports 9 can be more quickly ignited.

The position of the wire 8 in the intake pipe 3 is not limited provided the wire 8 does not influence the mixing of gas and air, and is determined e.g. by experiments or fluid simulations.

As described above, since the electric wire 8 is not exposed to the outside of the intake pipe 3, the wire 8 is least likely to be caught and damaged by an external object. Since the temperature of the gas-air mixture is always kept at around the normal temperature, the wire 8 is less likely to deteriorate due to overheating during use of the burner. This eliminates the need to provide the electric wire 8 with a shield plate to protect the wire 8. This simplifies the manufacturing steps of the burner and reduces its manufacturing cost.

Figure 3:
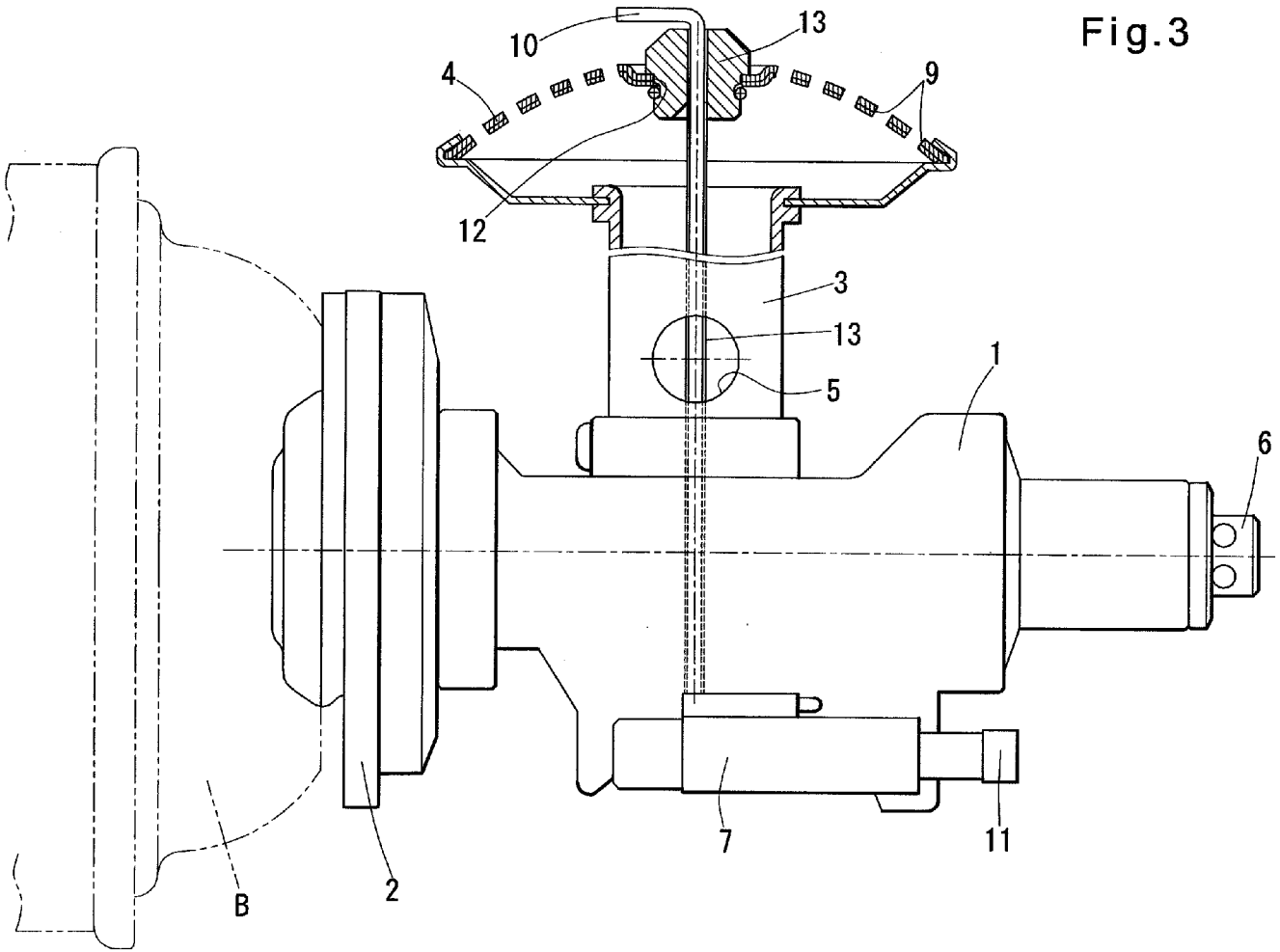
FIG. 3 is a partially sectional side view of a different burner embodying the present invention.

Instead of connecting the core wire 10 to the piezoelectric element 7 through the electric wire 8, as shown in FIG. 3, a terminal of the piezoelectric element 7 may be extended from the body of the piezoelectric element 7 to the burner head 4, while protecting the terminal with the ceramic insulator 13. In this arrangement, the free end of the terminal of the piezoelectric element 7 protrudes from the burner head 4 as the core wire 10. With this arrangement, it is not necessary to connect the electric wire 8 to the piezoelectric element 7, so that the burner can be more easily assembled and the number of parts used is reduced.

Figure 4A:
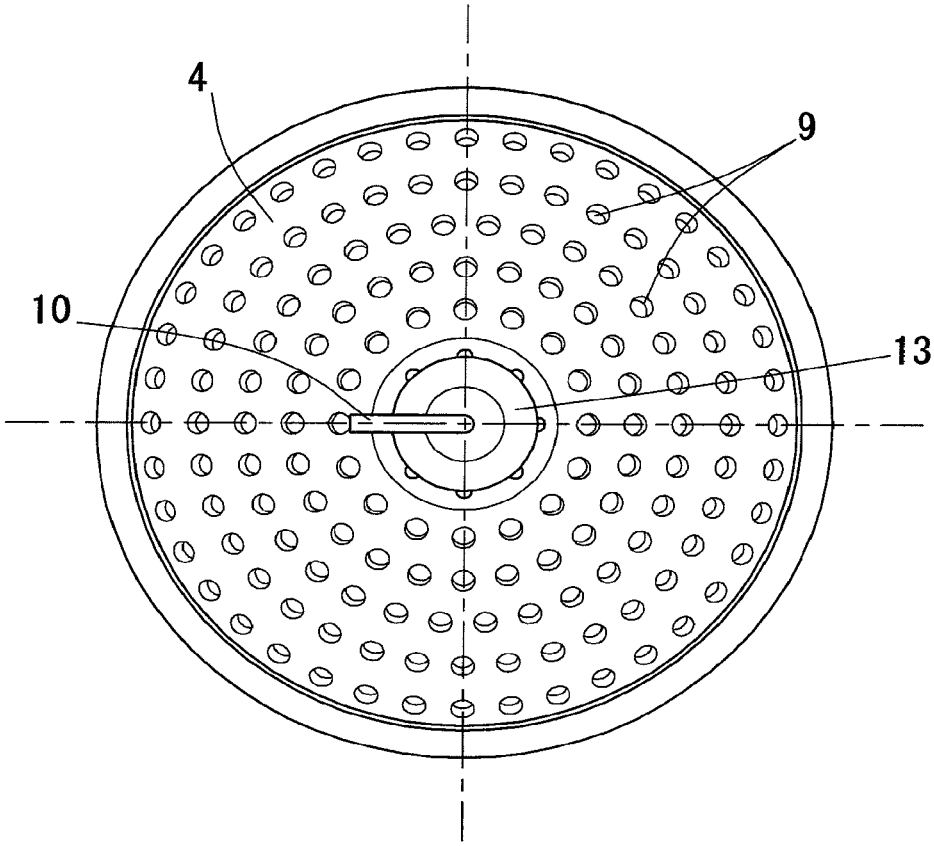
FIG. 4(*a*) is a plan view of a different burner head of the burner according to the present invention.
Figure 4B:
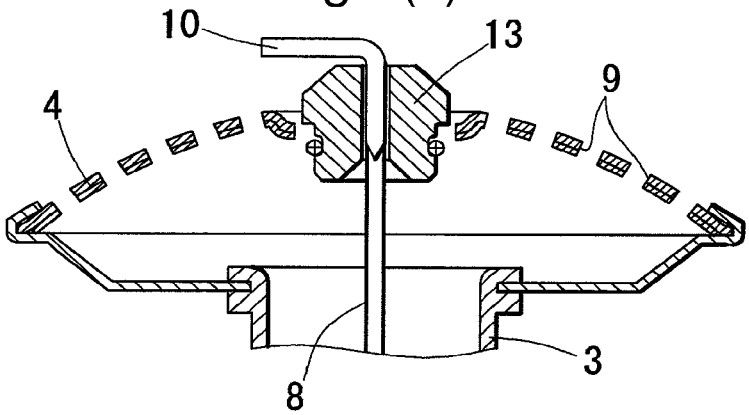

Instead of the burner head 4 shown in FIGS. 1 and 3, a burner head 4 shown in FIGS. 4(*a*) and 4(*b*) may be used, of which the radially innermost burner ports 9 are in contact with the outer edge of the ceramic insulator 13. The fact that the radially innermost burner ports 9 contact the ceramic insulator 13 does not have any detrimental influence on the burning condition of the burner.

The present invention is applicable to not only burners in a narrow sense but to burners in a broad sense including lanterns and heaters, because lanterns and heaters also have a burner head for burning an air-gas mixture.

Figure 5:
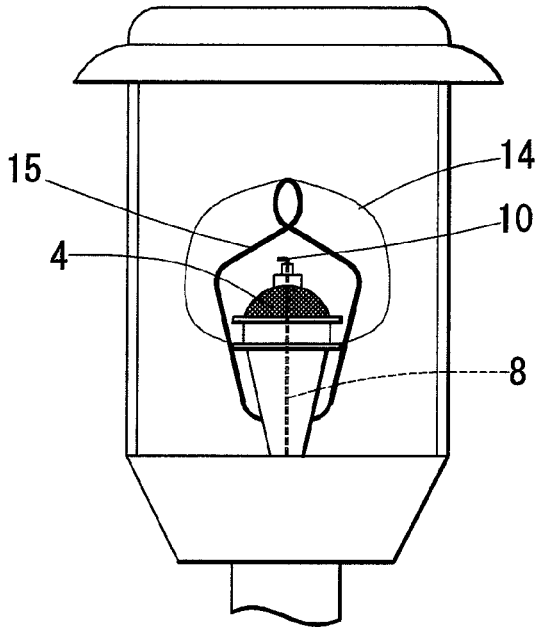
FIG. 5 is a side view of a lantern embodying the present invention.
Figure 6:
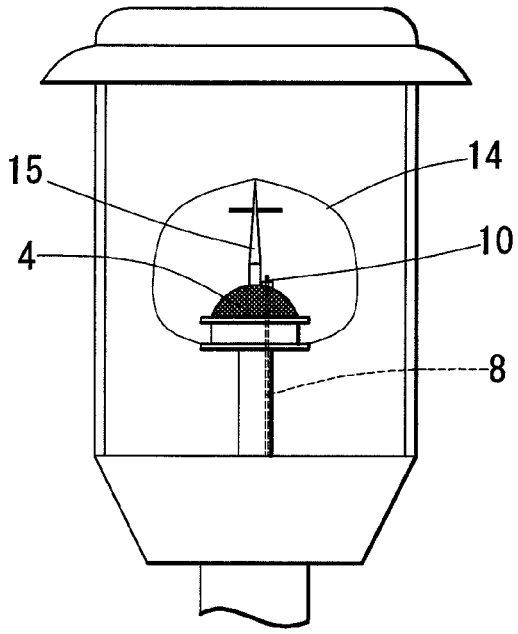
FIG. 6 is a side view of a different lantern embodying the present invention.
Figure 7:
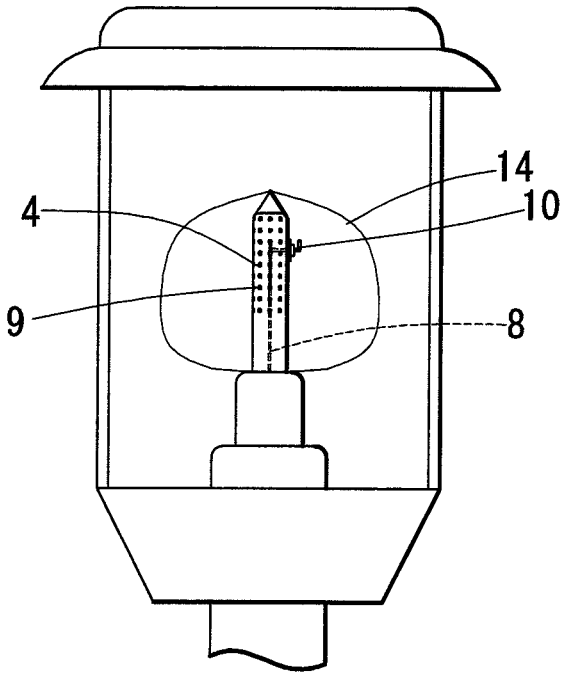
FIG. 7 is a side view of a still different lantern embodying the present invention.

Typical lanterns are shown in FIGS. 5 to 7. Any of these lanterns have a burner head covered by a bag-shaped mantle 14. Before use, the mantle 14 is burned into ash retaining the shape of the bag. In this state, the air-gas mixture discharged from the burner head 4 is burned so that light is emitted from the now ashy mantle 14.

In these lanterns too, as with the above-mentioned burner, the electric wire 8 or the terminal extends through the intake pipe, and the core wire 10 protrudes from the burner head 4. Electric discharge is generated from the core wire 10 to ignite the burner head 4, thereby emitting light from the mantle 14 (see FIG. 5). FIG. 6 shows another lantern embodying the present invention, in which the core wire 10 is provided adjacent to a support member 15 supporting the mantle 14 to generate electric discharge between the core wire 10 and the support member 15. FIG. 7 shows still another lantern embodying the present invention, in which the burner ports 9 of the burner head 4 are directed in horizontal directions, and the core wire 10 protrudes from the burner head 4 in a horizontal direction so that electric discharge occurs between the core wire 10 and the burner head 4.

The above-mentioned heater includes a burner head for burning an air-gas mixture to produce radiant heat, and radiate the thus generated radiant heat in a predetermined direction by means of a reflecting plate. Since the basic elements of this heater, including the burner head, are identical to those of an ordinary burner, this invention is applicable to this heater too.

In the above embodiments, the piezoelectric element 7 is used to generate electric discharge. But means for generating electric discharge is not of importance in the present invention, and different means may be used to generate electric discharge, such as dry cells.

According to the present invention, the fire power of the burner is adjusted by pushing in the spindle 6, which is an element of a regulator, thereby adjusting the degree of opening of a valve body 19. Since the valve body 19 is biased in a straight line in the axial direction of the spindle 6, the fire power is accurately adjustable.

Figure 8:
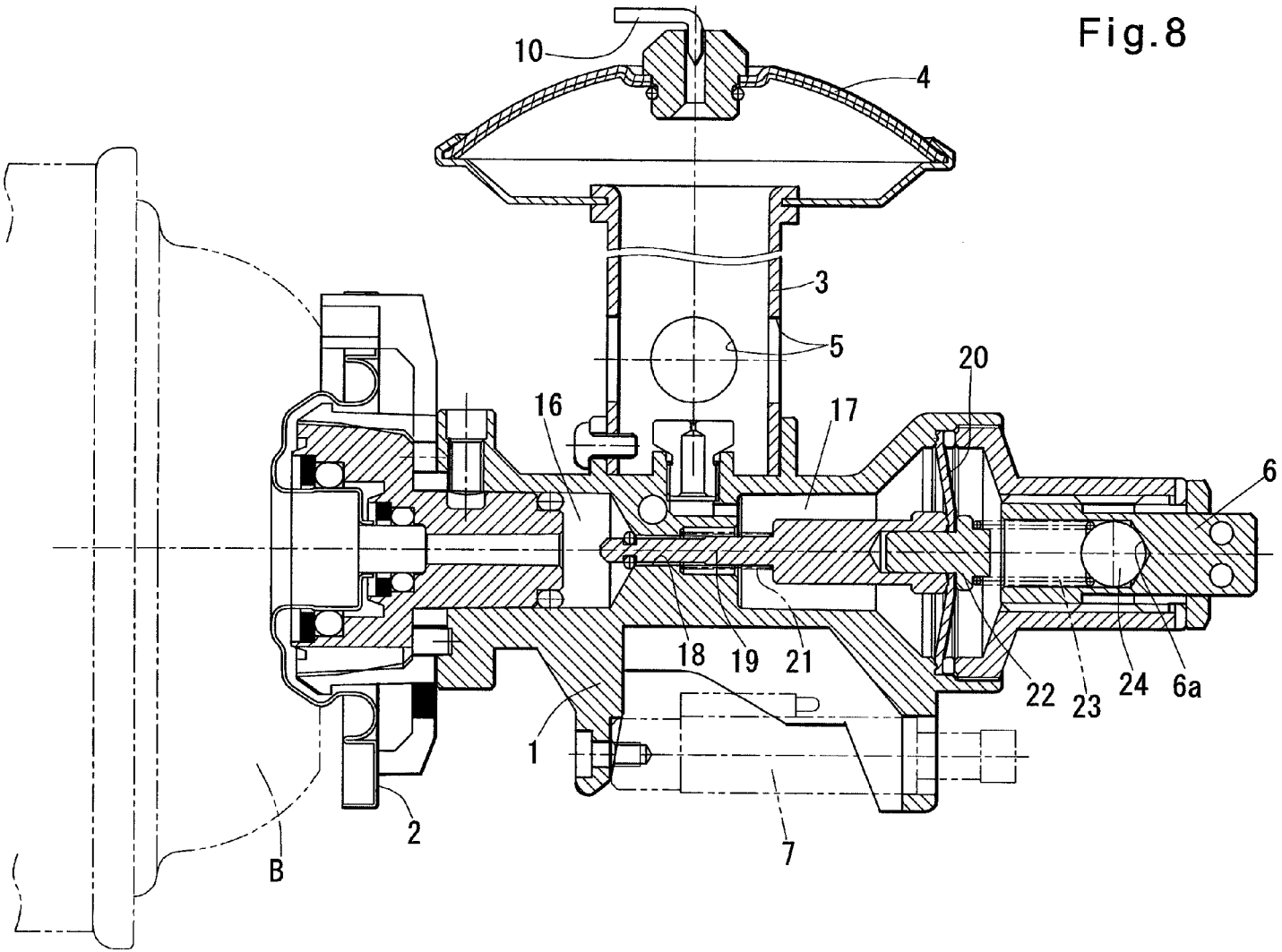
FIG. 8 is a partially sectional side view of the burner according to the present invention, showing the detailed structure of its regulator.

In particular, as shown in FIG. 8, the regulator of the burner comprises a primary gas chamber 16 defined in the housing 1, a secondary gas chamber 17 defined in the housing 1 of which the gas pressure is lower than in the primary gas chamber 16, a fluid passage 18 connecting together the primary and secondary gas chambers 16 and 17, the valve body 19, which is provided in the fluid passage 18, a diaphragm 20 biasing the valve body 19 toward its closed position while preventing leakage of gas from the housing 1, a counter spring 21 that adds to the biasing force of the diaphragm 20 in the valve closing direction, an adjusting spring 23 biasing the valve body 19 toward its open position through a coupling member 22 and the diaphragm 20, and the spindle 6. By pushing in the spindle 6, the adjusting spring 23 is pushed in the valve-opening direction. A spherical member 24 is disposed between the adjusting spring 23 and the spindle 6. The adjusting spring 23 is coupled to the valve body 19 through the coupling member 22.

Since the spherical member 24 has a diameter larger than the coil diameter of the adjusting spring 23, when the spherical member 24 is brought into contact with the end of the adjusting spring 23 from its axial direction, the spherical member 24 is kept in line contact with the end of the adjusting spring 23 along an annular line without being getting into the adjusting spring 23. Thus, even if the spindle 6 is slightly inclined relative to the axis of the housing when the spherical member 24 is pushed in by the spindle 6, they remain in line contact with each other along an annular line.

The spindle 6 has a conical tapered surface 6*a* on its inner side, and the spherical member 24 is guided in the axial direction of the spindle 6 while being stably received in the recess defined by the conical tapered surface 6*a*. This minimizes looseness between the spindle 6 and the spherical member 24, so that the spindle 6 and the spherical member 24 are stably kept in line contact with each other along an annular line. The tapered surface 6*a* is not limited to a conical surface but may be e.g. in the shape of a square pyramid, provided the spherical member 24 can be stably guided by such a tapered surface.

Figure 9:
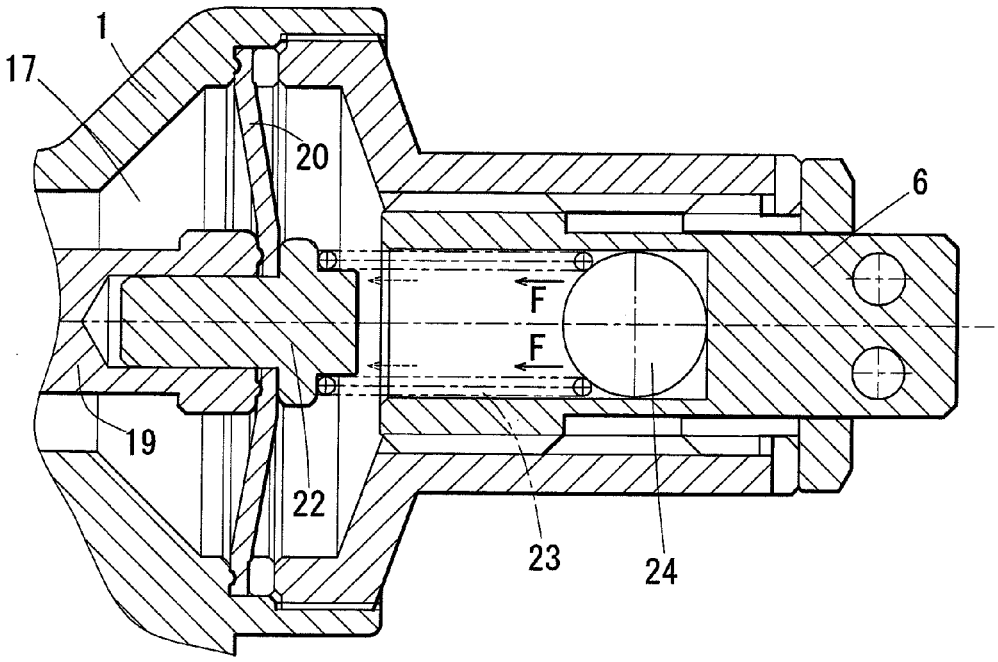
FIG. 9 is a sectional side view of a different regulator embodying the present invention.
Figure 10:
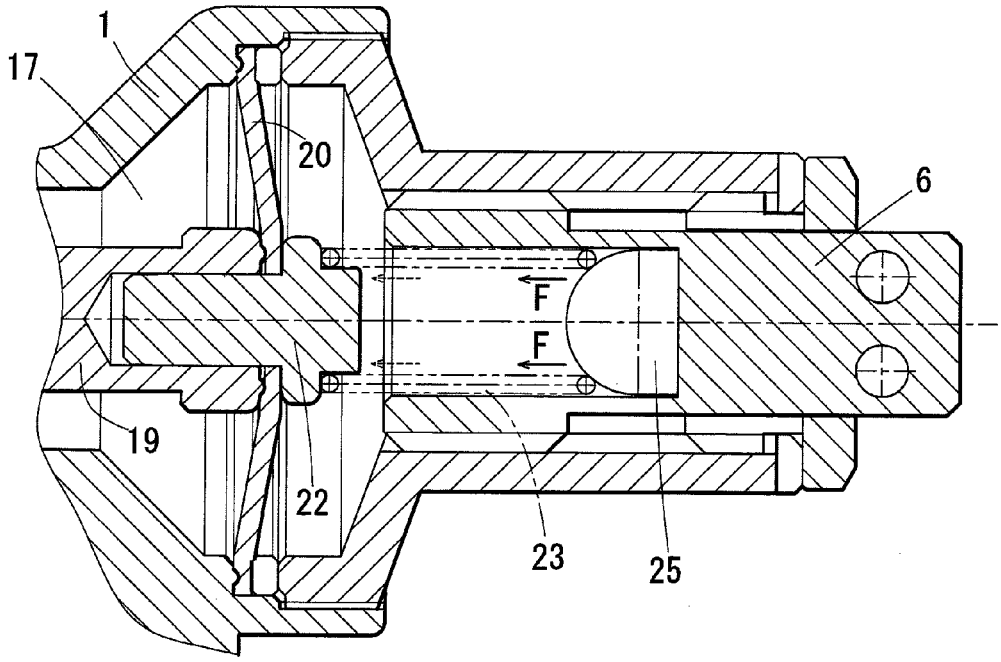
FIG. 10 is a sectional side view of a still different regulator embodying the present invention.
Figure 11:
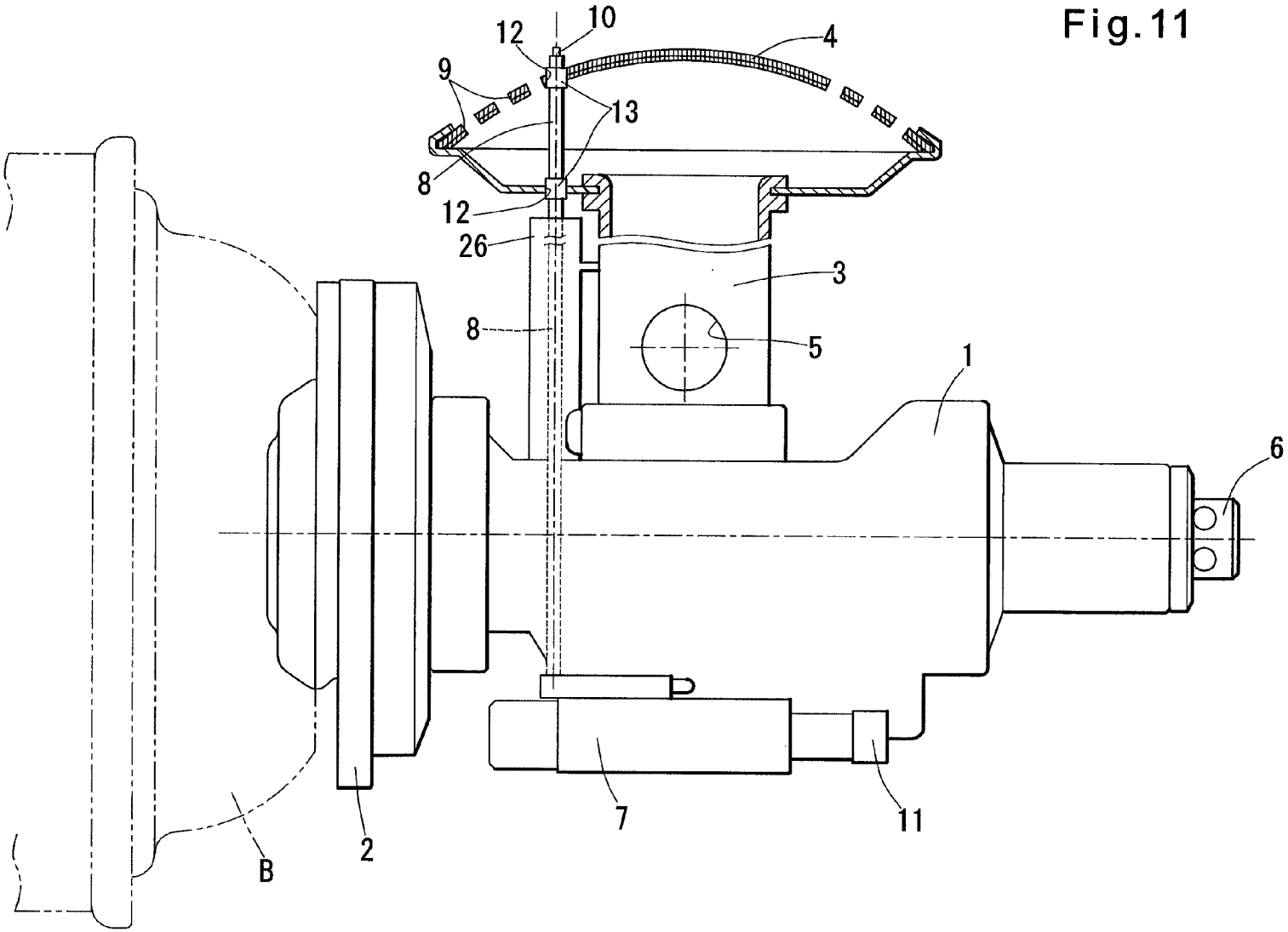
FIG. 11 is a partially sectional side view of an ordinary burner.

The regulator is not limited to the one shown in FIG. 8. For example, a regulator shown in FIG. 9 may be used instead, of which the spindle 6 has no tapered surface 6*a* so that the spindle 6 and the spherical member 24 make point contact with each other. Also, as shown in FIG. 10, instead of the spherical member 24, a bullet-shaped spacer having a spherical surface at the front end may be used. In any of these arrangements, since the adjusting spring 23 is kept in line contact with the spherical member 24 or the bullet-shaped spacer 25 along an annular line, it is possible to stably maintain the desired degree of opening of the valve body 19.

What is claimed is:

1. A burner comprising:

a burner head having burner ports;

an intake pipe through which a mixture of gas and air is to be supplied to the burner head so as to be released through the burner ports, said intake pipe being connected to said burner head;

a core wire provided adjacent to the burner ports;

an electric discharge generator arranged to generate electric discharge from the core wire, to thereby ignite the mixture;

an electric wire extending from said electric discharge generator into said burner head so as to connect the electric discharge generator to the core wire;

wherein said burner head is formed with a through hole through which the core wire extends from inside to outside the burner head;

wherein an insulator is disposed between the core wire and the burner head to keep the core wire insulated from the burner head; and wherein said electric wire extends through said intake pipe from said electric discharge generator to said burner head, so that said electric wire is disposed entirely within said intake pipe from said electric discharge generator until the electric wire reaches said burner head.

2. The burner of claim 1 wherein said electric discharge generator comprises a piezoelectric element.

3. A burner comprising:

a burner head having burner ports;

an intake pipe through which a mixture of gas and air is to be supplied to the burner head so as to be released through the burner ports, said intake pipe being connected to said burner head;

a core wire provided adjacent to the burner ports; and an electric discharge generator arranged to generate electric discharge from the core wire, to thereby ignite the mixture;

wherein said electric discharge generator has an electric discharge generator body and an electric discharge generator terminal that is extended from the electric discharge generator body to the burner head so that one end of said electric discharge generator terminal protrudes from the burner head, said core wire comprising said one end of said electric discharge generator terminal; and wherein said electric discharge generator terminal extends through said intake pipe from said electric discharge generator body to said burner head, so that said electric discharge generator terminal is disposed entirely within said intake pipe from said electric discharge generator body until the electric discharge generator terminal reaches said burner head.

4. The burner of claim 3 wherein said electric discharge generator comprises a piezoelectric element.

* * * * *